US006097264A

United States Patent [19]

Vezmar

[11] Patent Number: 6,097,264

[45] Date of Patent: Aug. 1, 2000

[54] BROAD BAND QUAD RIDGED POLARIZER

[75] Inventor: John M. Vezmar, Garner, N.C.

[73] Assignee: Channel Master LLC, Smithfield, N.C.

[21] Appl. No.: 09/104,447

[22] Filed: Jun. 25, 1998

[51] Int. Cl.[7] ..... H01P 1/17

[52] U.S. Cl. ..... 333/21 A; 333/157

[58] Field of Search ..... 333/21 R, 21 A, 333/239, 208, 248, 157

[56] References Cited

U.S. PATENT DOCUMENTS

| | | | |
|---|---|---|---|
| 3,002,163 | 9/1961 | Kahn | 333/21 R |
| 3,758,882 | 9/1973 | Mörz | 333/21 A |
| 4,672,334 | 6/1987 | Saad | 333/21 A |

FOREIGN PATENT DOCUMENTS

| | | | |
|---|---|---|---|
| 54-13752 | 2/1979 | Japan | 333/21 A |

OTHER PUBLICATIONS

Lier and Schaug–Pettersen, "A Novel Type of Waveguide polarizer with Large Cross–Polar Bandwith", *IEEE Transactions on Microwave Theory and Techniques*, vol. 36, No. 11, Nov. 1988.

Hoefer and Burton, "Closed–Form Expressions for the Parameters of Finned and Ridge Waveguies", *IEEE Transactions on Microwave Theory and Techniques,* vol. TT–30, No. 12, Dec. 1982.

Hopfer, "The Design of Ridge Waveguides", *IRE Transactions Microwave Theory and Techniques,* Oct. 1955.

Hopfer, *The Design of Ridged Waveguides*, IRE Trans. on MTT, pp. 20–29, Oct. 1955.

*Primary Examiner*—Paul Gensler
*Attorney, Agent, or Firm*—Darby & Darby

[57] ABSTRACT

A broad band waveguide polarizer having four axial ridges, one on each wall of the waveguide, is disclosed. The axial ridges are configured to provide different phase velocities for the orthogonal signal components of a linearly polarized input signal. The dimensions of the ridges are selected such that the net phase difference between the signal components is about 90 degrees at a predetermined signal frequency. The quad ridge polarizer may be manufactured as an integral die cast device.

12 Claims, 5 Drawing Sheets

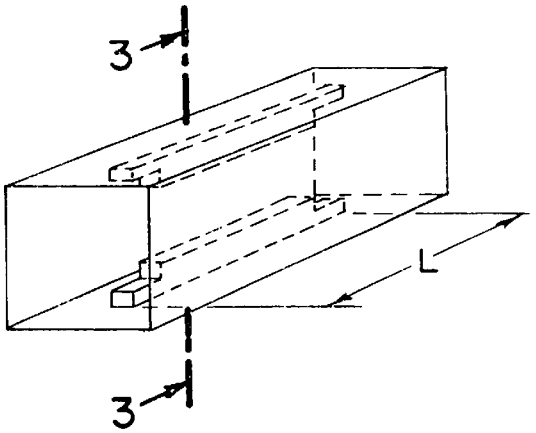
FIG. 2d
PRIOR ART
FIG. 4
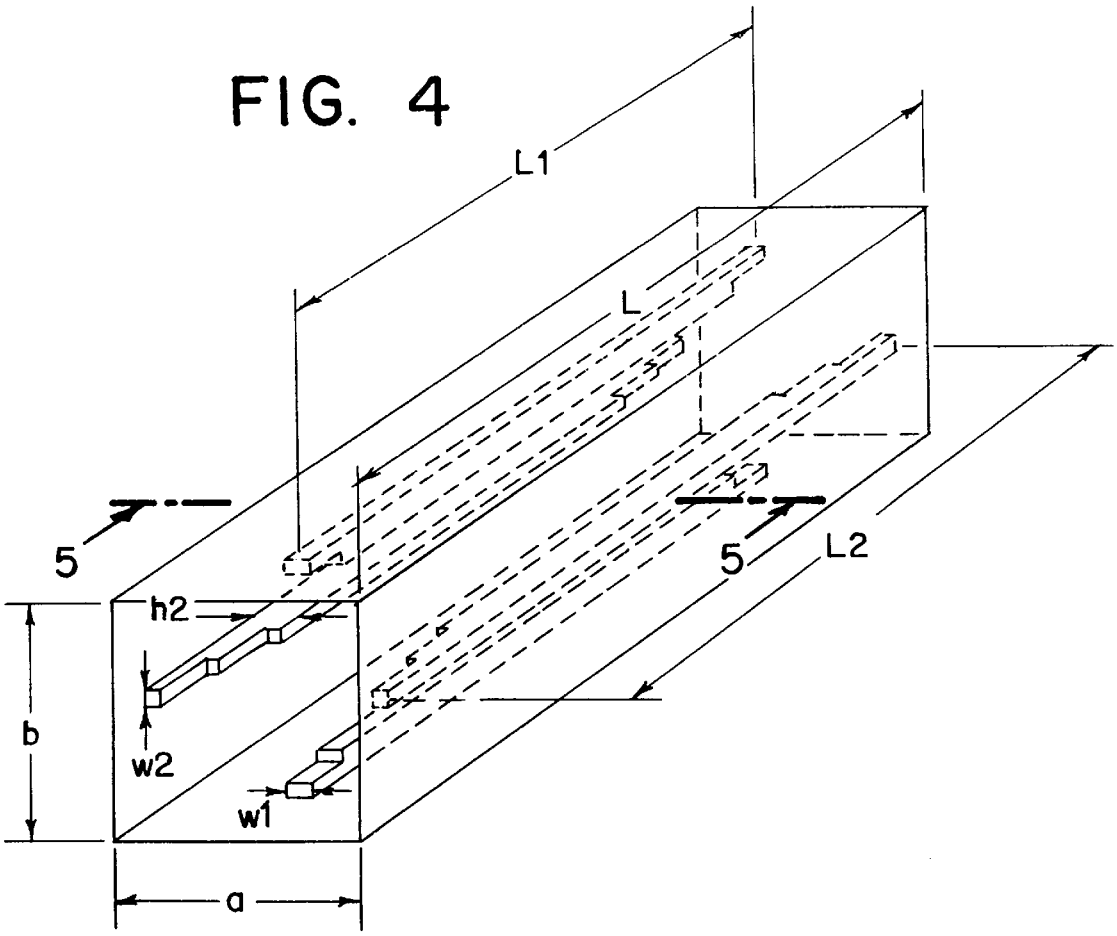

BROAD BAND QUAD RIDGED POLARIZER

TECHNICAL FIELD

This invention is related to a broad band waveguide polarizer. More particularly, this invention is related to a broad band waveguide circular polarizer which can be manufactured using die cast fabrication techniques.

BACKGROUND OF THE INVENTION

Waveguide polarizers are phase shifters which receive a linearly polarized signal as input and convert it into a circularly polarized output signal. Waveguide polarizers operate by separating an input signal, E, into two orthogonal electric field signal components, Ex and Ey. One signal component is delayed relative to the other to introduce a phase shift of 90 degrees. To achieve a 90 degree difference, the period of delay is chosen to be one-quarter of the wavelength of the signal in the waveguide at the desired frequency. The combination of the two signal components results in a circularly polarized signal, also known as a rotating linear signal.

Waveguide polarizers typically have rectangular or circular cross sections. A generic rectangular waveguide, where the waveguide walls are aligned with the X and Y axes, is illustrated in FIG. 1. A linearly polarized input signal is aligned so that the signal polarity is from corner to corner of the waveguide entrance. Differences in the electrical properties between the two pairs of opposing walls delays one of the components relative to the other by about 90 degrees to provide a circularly polarized output signal.

Waveguide polarizers are generally used in high frequency applications such as transmitters and receivers for satellite communication, as well as various radar applications. Although it is relatively easy to construct a polarizer which provides an optimum phase difference of 90 degrees between Ex and Ey for a single frequency, it is more difficult to produce a polarizer with a wide bandwidth because the phase delay of a signal component varies according to the wavelength of the input signal.

The theoretical bandwidth of a rectangular waveguide polarizer is limited to frequencies between $c/2a_n$ and $c/a_w$, where c is the speed of light and $a_n$ and $a_w$ are the width of the waveguide along the narrowest and widest side, respectively. The lower frequency limit is the frequency where signals do not propagate and therefore the waveguide cuts off. The higher frequency limit is the frequency where higher order signal modes begin to propagate in the waveguide, interfering with the dominent/desired mode signal. For optimum circular polarity, the phase difference should be 90 degrees. Reasonably good circular polarization is achieved with a phase difference between about 80 degrees and 100 degrees. This range may be considered to be the usable waveguide bandwidth. Of course, other definitions of good polarization may be used according to the demands of the application.

Various methods have been employed to increase the available bandwidth of polarizers. In one configuration, shown in FIG. 2*a*, a dielectric slab is introduced inside a circular waveguide. The dimensions and composition of the slab are chosen so that one signal component is delayed relative to the other as required. FIG. 2*b* is an illustration of a dielectric loaded rectangular waveguide. In this type of waveguide, a different type of dielectric material is applied to each pair of opposing walls. The two different materials provide different phase velocities for the propagating signal components in the waveguide. With the proper selection of dielectric materials, good performance over a broad band can be achieved. However, the required dielectric materials are relatively costly. In addition, it is difficult to repeatably manufacture waveguides of this type which have the same characteristics without fine tuning individual units to achieve the proper performance. Accordingly, waveguide polarizers relying on dielectrics are too expensive to manufacture in large quantities for many commercial applications.

An alternate waveguide configuration is illustrated in FIG. 2*c*. In this configuration, transverse corrugations or slots are introduced along one wall of the waveguide or on opposing walls. The corrugations may be formed of the same material as the conducting waveguide, such as metal, and function as an artificial dielectric. In the waveguide of FIG. 2*c*, the propagation velocity of signal components in the corrugated walls will differ from the velocity in the flat walls. By adjusting the geometry of the corrugations appropriately, a phase shift of 90 degrees may be achieved for a limited frequency range. However, while the use of a dielectric is avoided, the transverse nature of the corrugations requires that they be investment cast or machined, production techniques which become significantly more expensive for high volume production when compared to die cast fabrication.

Transverse corrugations on two opposing walls of a rectangular waveguide may be combined with dielectric loading on the other two flat walls as discussed by E. Lier and T. Schaug-Pettersen in *A Novel Type of Waveguide Polarizer with large Cross-Polar Bandwidth*, IEEE Transactions on Microwave Theory and Techniques, Vol. 23, No. 11, p. 1531–1534, November 1988. The polarizer configuration disclosed by Lier and Schaug-Pettersen has approximately a 40% bandwidth with a 20 dB polarization ratio, or a phase difference of between 78.58 to 101.42 degrees. While this arrangement may provide an increased bandwidth over the waveguide of FIG. 2*c*, it still is subject to the manufacturing difficulties introduced by the transverse corrugations, in addition to the greater cost and repeatability concerns which result from the use of dielectrics.

Lier and Schaug-Pettersen also note that transverse corrugations have been placed on all four walls of the waveguide in an attempt to increase bandwidth. However, even though the use of a dielectric is avoided in this arrangement, the usable bandwidth is limited when compared with other waveguides, particularly ridged waveguides, discussed below, because the low end cutoff frequency and high order mode propagation frequency are not extended at all by the additional corrugations. In addition, placing corrugations on all four walls compounds the manufacturing difficulties introduced by adding transverse corrugations to only one or two walls.

Yet another polarizer configuration is illustrated in FIGS. 2*d* and 3. In the waveguide of FIG. 2*d*, an axial ridge is provided on one wall of a rectangular waveguide (single ridged) or on a pair of opposing walls (dual ridged), while the remaining walls are left blank. As shown in the cross-section of FIG. 3, the added ridges alter the propagation velocity of signal component E1 travelling perpendicular to the ridged walls compared to the component E2 traveling perpendicularly to the flat walls. The characteristics of the waveguide may be determined by adjusting the height (h), width (w), and length (L) of the ridges using techniques well known to those skilled in the art.

Although single and dual ridge polarizers are suitable for mass production using techniques such as die casting, these polarizers have a relatively narrow usable bandwidth because the phase characteristics of the ridged wall(s) differ considerably from that of the adjacent blank walls. Thus, outside of the "center" frequency, where the designed 90 degree phase shift is present, the phase shift curves for the two signal components diverge quickly, resulting in a relatively narrow region where good circular polarization is achieved, i.e., a phase difference between Ex and Ey of, for example, 80 and 100 degrees.

Accordingly, it is an object of the present invention to provide a waveguide polarizer which has a wide operating bandwidth over which good circular polarization is achieved.

It is a further object of the invention to provide a waveguide polarizer which may be inexpensively fabricated using die cast techniques.

Yet another object of the invention is to provide a waveguide polarizer which does not require the use of dielectric materials.

SUMMARY OF THE INVENTION

According to the invention, these and other objects are achieved by providing a waveguide polarizer having four axial ridges, one on each wall, as opposed to the conventional dual ridged polarizer design. The length, width, and height of the ridges provide sufficient freedom of design to achieve two different phase velocities required for broad band performance. Unlike waveguides which require dielectrics or use transverse corrugations, the polarizer according to the invention may be accurately and inexpensively fabricated in large volumes using die casting techniques.

The use of ridges provides a greater bandwidth for the polarizer than similar polarizers fabricated with transverse corrugations because the ridges reduce the cutoff frequency and increase the frequency at which higher order modes can occur. Transverse corrugations do not change the cut off frequency or higher order mode propagation frequency at all. In fact, if not carefully designed, corrugations can actually excite unwanted high order modes.

In addition, the two pairs of opposing ridges have a similar geometry and so the phase-frequency characteristics curves do not diverge from each other quickly. This provides an increase in the usable polarization frequency range when compared with conventional single or dual ridge waveguide polarizers. The ridges do not need to extend the full length of the waveguide and may be stepped to match the impedance of the polarizer to a standard input and output waveguide.

BRIEF DESCRIPTION OF THE DRAWINGS

The foregoing and other features of the present invention will be more readily apparent from the following detailed description and drawings of illustrative embodiments of the invention in which:

FIGS. 2*a*–2*d* are transparent perspective views of various conventional waveguide polarizers;

FIG. 4 is a transparent perspective view of a quad ridge polarizer according to the invention;

DETAILED DESCRIPTION OF THE PREFERRED EMBODIMENTS

Figure 1A:
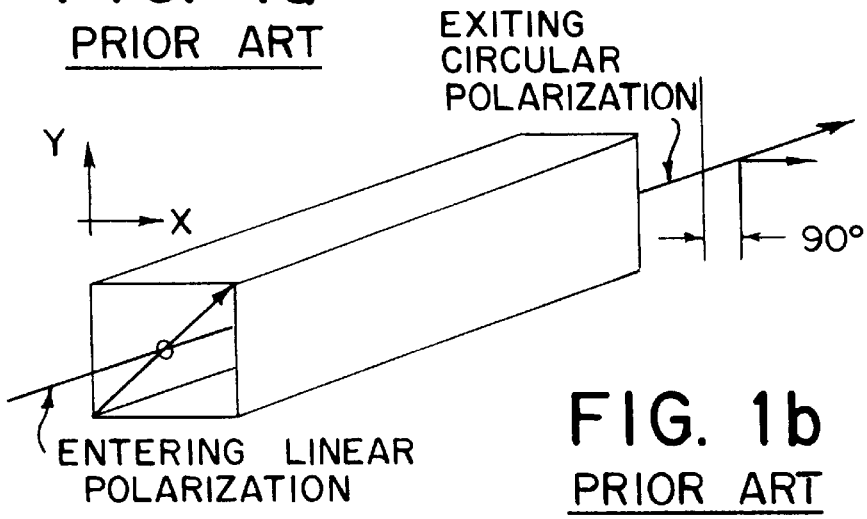
FIG. 1a PRIOR ART
FIG. 1 is a perspective view of a generic rectangular waveguide polarizer.
Figure 1B:
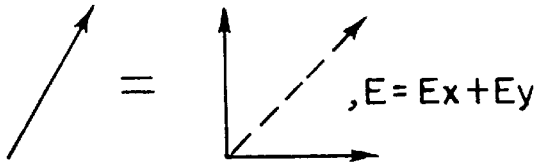
FIG. 1b PRIOR ART
Figure 2A:
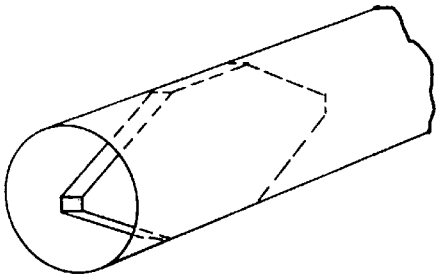
FIG. 2a PRIOR ART
Figure 2B:
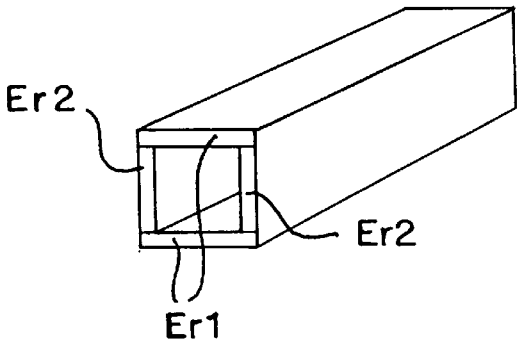
FIG. 2b PRIOR ART
Figure 2C:
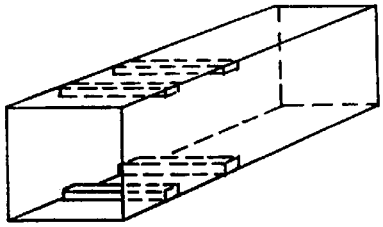
FIG. 2c PRIOR ART
Figure 3:
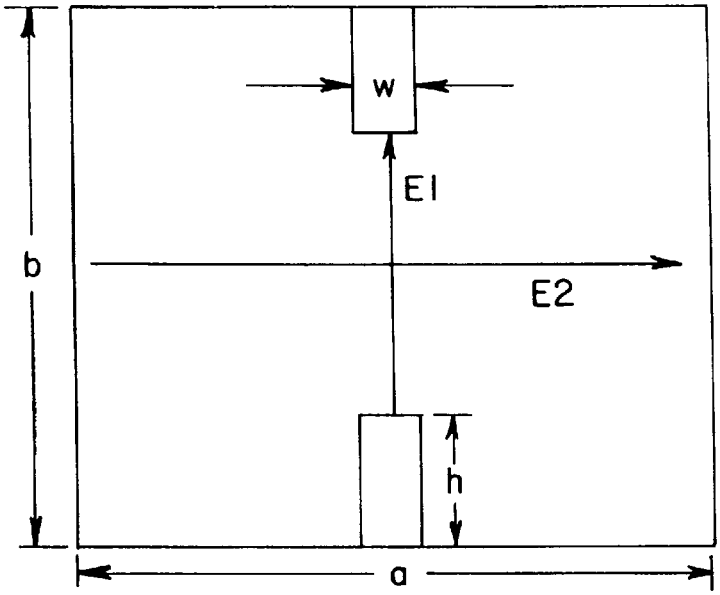
FIG. 3 PRIOR ART
FIG. 3 is a cross sectional view of a conventional dual ridge polarizer shown in FIG. 2*d* along line 3—3.
Figure 5:
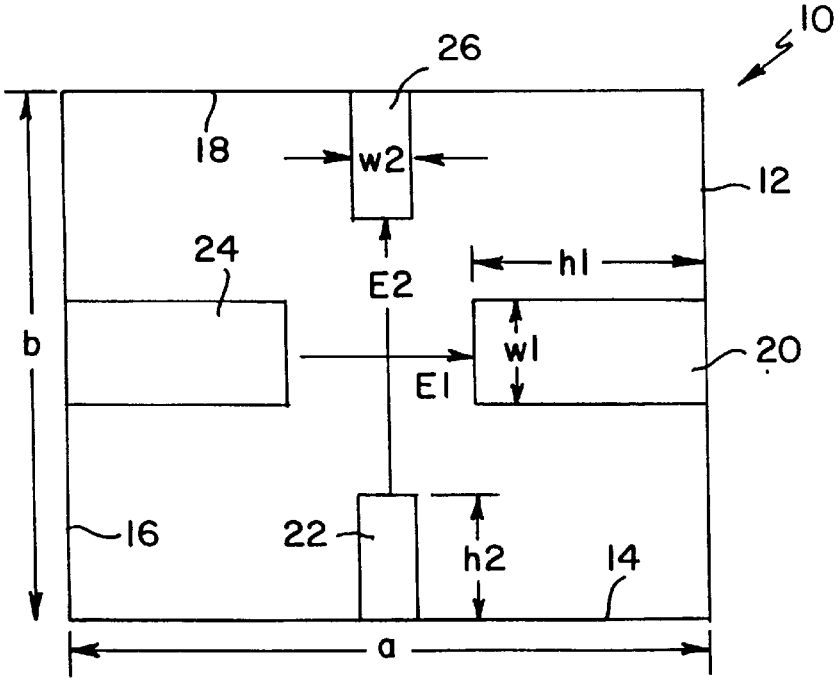
FIG. 5 is a cross sectional view of the quad ridged polarizer shown in FIG. 4 along line 5—5.

Turning to FIGS. 4 and 5, there is shown a broad band quad ridge polarizing waveguide 10 according to the present invention. The waveguide has width a, height b, and length L. Preferably the height and width of the waveguide are equal. However this is not essential and the waveguide may have a rectangular or even a curved cross section. The waveguide 10 has four wall regions, such as walls 12, 14, 16, and 18, each having a respective axial ridge 20, 22, 24, 26. The inventive addition of a second pair of opposing ridges results in a lower cutoff frequency of the waveguide and increased frequency at which higher order modes can occur, therefore providing a device which will operate over a broader range of frequencies than comparable prior art devices, such as transverse corrugation polarizers. The second pair of ridges have similar phase vs. frequency characteristics as the first pair. This allows for non-divergent phase characteristics over a larger bandwidth than conventional single or dual ridge polarizers.

Preferably, opposing ridges 20, 24 and 22, 26 are in alignment with each other. More preferably, each of the ridges is positioned equally distant from the two adjacent wall regions and run down the center of the wall on which it is located, as shown in the cross-section of FIG. 5. Most preferably, opposing ridges 20, 24 and 22, 26 are symmetric to each other and ridge pair 20, 24 has a different geometry than ridge pair 22, 26.

The most preferred embodiment is shown in FIGS. 4 and 5. The first pair of opposing ridges 20, 24 each have a height h1 inward from the respective walls 12, 16, a width w1, and a length L1. The height, width, and length of these ridges determines the phase shift of signal component E1. Similarly, the second pair of opposing ridges 22, 26 each have a height h2 inward from respective walls 14, 18, a width w2, and a length L2. The dimensions of ridges 22, 26 determine the phase shift of the other signal component, E2. The design of single and dual axial ridges is well known to those of skill in the art. See, e.g., W. Hoefer and M. Burton, *Closed-Form Expressions for the Parameters of Finned and Ridged Waveguides*, IEEE Transactions on Microwave Theory and Techniques, Vol. MTT-30, No. 12, pp. 2190–2194, December 1982. Similar techniques may be utilized to select the proper dimensions for the additional ridges provided in the quad ridge configuration of the present invention.

Advantageously, the variability in the height, width, and length of the four ridges allows sufficient freedom of design to achieve the two different phase velocities as required for broad band performance. The difference in phase between signal components E1 and E2 is designed to provide a circularly polarized output signal within the frequency range of interest. A wide bandwidth can be achieved if the phase characteristics of the orthogonal signal components E1 and E2 entering the waveguide 10 are approximately 90 degrees apart and have the same curvature over a wide frequency range. An exact match in curvature is achieved when both pairs of ridges are identical. However, this situation would not introduce the necessary phase difference between the components.

According to the invention, the dimensions of the ridges may be chosen to provide similar phase characteristics with close to a 90 degree phase difference over a wide frequency range. One configuration for achieving this result is for the first pair of ridges 20, 24 to have a relatively large width w1 and height h1, but a small length L1, while the second pair of ridges 22, 26 have a comparatively narrow width w2, small height h2, but a long length L2. In other words, w1 is greater than w2, h1 is greater than h2, and L1 is less than L2. Generally, the ridge width is not as critial a dimension as the length and height while in general, a relatively large height corresponds to a relatively small length. So in an alternate configuration, w1 is equal to or even less than w2 while h1 is greater than h2, and L1 is less than L2.

Preferably, the ends of the ridges are also stepped, as illustrated in FIG. 4. Stepping the ridges reduces the mismatch in impedance which results when there is an abrupt transition from a smooth to ridged waveguide wall by providing a gradual impedance transformation between the ridged portion of the waveguide and the input and output waveguide portions, which may be rectangular, square, or even curved. The design of stepped ridges is well known to those skilled in the art. See, e.g., S. Hopfer, *The Design of Ridged Waveguides*, IRE Transactions on Microwave Theory and Techniques, Vol. MTT-3 pp. 20–29, October 1955.

Figure 6:
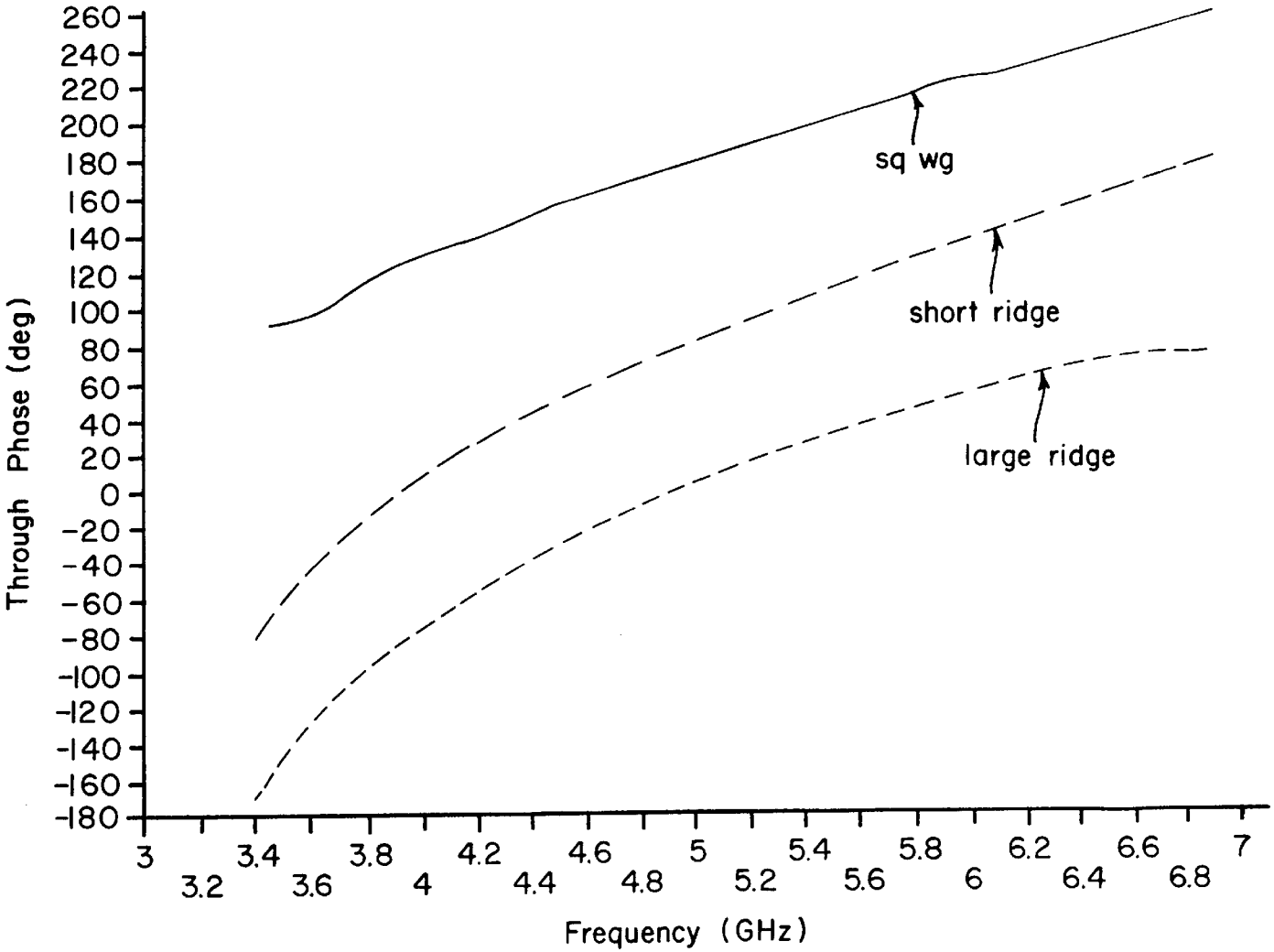
FIG. 6 is a graph of the phase characteristics of signal components according to frequency in a representative rectangular waveguide with and without axial ridges.

The performance of a conventional dual ridge polarizer will now be compared with a quad ridged polarizer according to the invention. Turning now to FIG. 6, there is shown a graph of typical transmission phase characteristics of a signal component which is passed though various waveguide configurations. In the graph, the solid line represents the phase characteristics of a signal vector, such as E1, in a flat portion of a conventional square waveguide, i.e., without ridges, the long dashed line represents the phase characteristics in a waveguide portion with small height ridges, and the short dashed line represents the phase characteristics in a waveguide portion with large height ridges.

Figure 7:
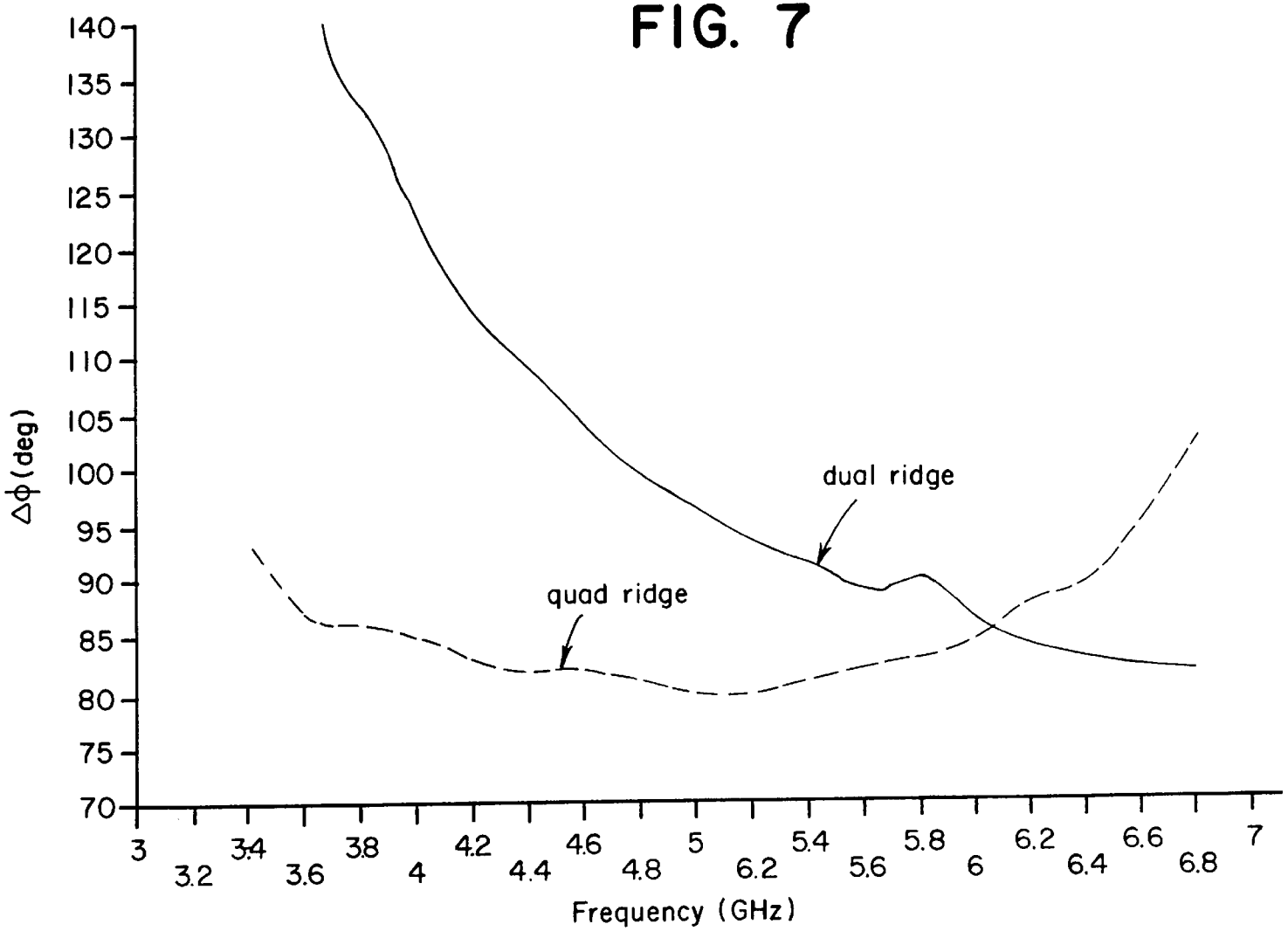
FIG. 7 is a graph of the phase difference between the signal components in a dual ridge polarizer and a quad ridge polarizer according to the invention.

A conventional dual ridged polarizer contains two flat walls and two ridged walls. The phase difference between the two signal components in the waveguide, here the difference between the solid line and the long dashed lines of FIG. 6, is shown as the solid line in FIG. 7. In the quad ridged polarizer of the invention, the long dashed line and the short dashed line of FIG. 6 represent typical phase characteristics of the two signal components. The phase difference is shown as the dashed line in FIG. 7. As can be seen, the quad ridge polarizer provides similar phase characteristics for the signal components with close to a 90 degree phase difference over a much wider frequency range than that of a conventional dual ridge design, particularly in the lower frequencies.

A typical quad ridged polarizer according to the invention has a 20 dB polarization ratio over a 61% bandwidth. This is significantly greater than the approximately 40% bandwidth disclosed for the hybrid transverse ridge/dielectric waveguide disclosed by Lier and Schaug-Pettersen, discussed above. Advantageously, and contrary to the transverse corrugated waveguides, the quad ridged waveguide of the invention may be inexpensively and accurately manufactured as an integrally molded component using die cast fabrication techniques and without the use of dielectric materials. Preferably the waveguide is aluminum or zinc, depending on the size. However, other conventional materials, such as copper, may also be used.

While the invention has been particularly shown and described with reference to preferred embodiments thereof, it will be understood by those skilled in the art that various changes in form and details may be made therein without departing from the spirit and scope of the invention. In particular, while the invention has been primarily discussed with respect to rectangular waveguides, the quad ridged design may be extended to waveguides of other shapes, such as circular or elliptical.

I claim:

1. A signal polarizer comprising:

a waveguide having two pairs of opposing side wall regions surrounding an interior portion and defining a central axis; and first and second pairs of opposing ridges, each ridge formed on the interior of at least a portion of a respective side wall region and extending along said respective wall in alignment with the central axis, a height of the ridges in the first pair is greater then a height of the ridges in the second pair: and a length of the ridges in the first pair is less than a length of the ridges in the second pair.

2. The polarizer of claim 1, wherein ridges on opposing wall regions are in alignment with each other.

3. The polarizer of claim 2, wherein opposing ridges are symmetric to each other.

4. The polarizer of claim 1, wherein the width of ridges in the first pair is greater than the width of the ridges in the second pair.

5. The polarizer of claim 1, wherein the width of ridges in the first pair is less than the width of the ridges in the second pair.

6. The polarizer of claim 1, wherein at least one of said ridges has a plurality of steps along its length.

7. The polarizer of claim 1, wherein said waveguide is square.

8. The polarizer of claim 1, wherein said ridges are integral with each said wall region.

9. A polarizer comprising:

a rectangular waveguide having two pairs of opposing side walls surrounding an interior portion and having a central axis, each said wall having a ridge formed on the interior portion therein and being in alignment with the central axis to form first and second pairs of opposing ridges;

a height of the ridges in the first pair being greater then a height of the ridges in the second pair; and a length of the ridges in the first pair being less than a length of the ridges in the second pair:

the first pair of opposing ridges being configured to have a first phase velocity for a first signal component traveling therein;

the second pair of opposing ridges being configured to have a second phase velocity for a second signal component traveling therein;

said first and second phase velocities providing a differential phase shift between said first and second signal components of approximately 90 degrees at a predetermined frequency.

10. The polarizer of claim 9, wherein:

a width of ridges in the first pair is greater than a width of the ridges in the second pair.

11. The polarizer of claim 9, wherein each of said ridges has a plurality of steps.

12. The polarizer as described in claim 9, wherein said ridges and walls are integrally fabricated by die casting.

* * * * *